US008147220B2

(12) United States Patent
Yanagisawa et al.

(10) Patent No.: US 8,147,220 B2
(45) Date of Patent: Apr. 3, 2012

(54) COMPRESSOR HAVING COMPRESSION ELEMENT WELDED TO CLOSED CONTAINER AT THREE OR MORE WELDING POINTS AND SUCTION TUBE NEITHER PARALLEL NOR PERPENDICULAR TO A STRAIGHT LINE CONNECTING ANY TWO OF THE WELDING POINTS

(75) Inventors: Masanori Yanagisawa, Kusatsu (JP); Kouki Morimoto, Kusatsu (JP); Takehiro Kanayama, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 230 days.

(21) Appl. No.: 12/097,372

(22) PCT Filed: Dec. 11, 2006

(86) PCT No.: PCT/JP2006/324669

§ 371 (c)(1),
(2), (4) Date: Jun. 13, 2008

(87) PCT Pub. No.: WO2007/069564

PCT Pub. Date: Jun. 21, 2007

(65) Prior Publication Data

US 2009/0232679 A1 Sep. 17, 2009

(30) Foreign Application Priority Data

Dec. 16, 2005 (JP) ..... 2005-362837

(51) Int. Cl.
*F04B 17/03* (2006.01)

(52) U.S. Cl. ..... 417/410.3; 417/423.15

(58) Field of Classification Search ..... 417/423.14, 417/312, 410.3, 423.15, 902
See application file for complete search history.

(56) References Cited

U.S. PATENT DOCUMENTS

| | | | | | |
|---|---|---|---|---|---|
| 4,526,522 | A | * | 7/1985 | Onoda | 418/63 |
| 4,601,644 | A | * | 7/1986 | Gannaway | 417/363 |
| 4,790,733 | A | * | 12/1988 | Vaccaro | 418/63 |
| 4,958,990 | A | * | 9/1990 | Gordon et al. | 417/410.3 |
| 2004/0219037 | A1 | * | 11/2004 | Higuchi et al. | 417/410.3 |
| 2005/0074354 | A1 | * | 4/2005 | Ebara et al. | 417/572 |

FOREIGN PATENT DOCUMENTS

| | | | | |
|---|---|---|---|---|
| JP | 64-041692 | A | | 2/1989 |
| JP | 02-275071 | A | | 11/1990 |
| JP | 05-099177 | A | | 4/1993 |
| JP | 2000-291577 | A | | 10/2000 |
| JP | 2003-239883 | | * | 8/2003 |
| JP | 2005-076527 | A | | 3/2005 |
| JP | 2005-245148 | A | | 9/2005 |

* cited by examiner

*Primary Examiner* — Devon C Kramer
*Assistant Examiner* — Bryan Lettman
(74) *Attorney, Agent, or Firm* — Global IP Counselors

(57) ABSTRACT

A compressor includes a closed container and a compression element welded together at least three, preferably six, welding points. A suction tube for sucking refrigerant gas is attached to the closed container. A first direction and a second direction that are associated with a natural vibration mode of the suction tube do not coincide with a direction in which any two of the welding points are aligned. Accordingly, vibration of the suction tube can be reduced by arrangement of the welding points even if vibration of a motor is transmitted to the compression element.

12 Claims, 4 Drawing Sheets

COMPRESSOR HAVING COMPRESSION ELEMENT WELDED TO CLOSED CONTAINER AT THREE OR MORE WELDING POINTS AND SUCTION TUBE NEITHER PARALLEL NOR PERPENDICULAR TO A STRAIGHT LINE CONNECTING ANY TWO OF THE WELDING POINTS

CROSS-REFERENCE TO RELATED APPLICATIONS

This U.S. National stage application claims priority under 35 U.S.C. §119(a) to Japanese Patent Application No. 2005-362837, filed in Japan on Dec. 16, 2005, the entire contents of which are hereby incorporated herein by reference.

BACKGROUND OF THE INVENTION

The present invention relates to a compressor used for, for example, an air conditioner, a refrigerator, or the like.

Conventionally, there has been a compressor which includes a closed container, a compression element located in the closed container, and a motor which is located in the closed container and drives the compression element through a shaft. The closed container and the compression element are welded at a plurality of welding points (see JP 2-275071 A).

However, the conventional compressor has a problem that when a suction tube with which an accumulator is connected is fitted to a suction port of the closed container, and a first direction which is the direction of a straight line connecting the central axis of a portion near the suction port of the suction tube to the central axis of the closed container or a second direction perpendicular to the first direction on a plane orthogonal to the central axis of the closed container coincides with the direction of a straight line connecting any two of the welding points to each other when viewed from the central axis of the closed container, the vibration of the motor is transmitted to the suction tube through the compression element and the welding points and thereby the suction tube and the accumulator significantly vibrate. The conventional compressor also has a problem that the suction tube vibrates also when the accumulator is not connected with the suction tube.

These problems are caused because the first direction and the second direction are associated with the natural vibration mode of the suction tube and the direction of a straight line connecting any two of the welding points to each other coincides with any one of the directions associated with the natural vibration mode of the suction tube.

It is therefore an object of the present invention to provide a compressor which is able to reduce the vibrations of the suction tube and/or the accumulator even if the motor vibrates.

SUMMARY OF THE INVENTION

A compressor according to the present invention comprises a closed container, a compression element located in the closed container, and a motor which is located in the closed container and which drives the compression element through a shaft, wherein the closed container and the compression element are welded together at three or more welding points, a suction tube for sucking refrigerant gas is fitted to a suction port of the closed container, and in a plane which is orthogonal to a central axis of the closed container and which passes through a central axis of a portion near the suction port of the suction tube, a direction in which a straight line connecting any two of the welding points extends coincides neither with a first direction in which the central axis of the portion near the suction port of the suction tube extends nor with a second direction perpendicular to the first direction.

According to the compressor of this invention, the direction of any of straight lines connecting any two of the welding points to each other does coincide neither with the first direction nor with the second direction, meaning that the directions of such straight lines deviate from both the first direction and the second direction which are associated with the natural vibration mode of the suction tube. Thus, the above arrangement of the welding points reduces the vibrations of the suction tube even if the vibrations of the motor are transmitted to the compression element. Furthermore, since the number of the welding points is three or more, a high supporting rigidity of the compression element is obtained.

In accordance with one aspect of the present invention, an accumulator is connected with the suction tube.

In a compressor in accordance with this aspect, because the vibrations of the suction tube are reduced even if the motor vibrates, the vibrations of the accumulator are also reduced.

In accordance with another aspect of the present invention, at least one of central angles each formed between adjacent two of the welding points is different from another one of the central angles.

In a compressor in accordance with this aspect, because at least one of the central angles formed between the respective adjacent two of the welding points is different from another one of the central angles, directions in which the vibrations of the motor are transmitted to the closed container are distributed, or made different and thereby the vibration of the closed container is allowed to be reduced.

In accordance with another aspect of the present invention, the number of the welding points is an even number, all of the welding points are divided into two or more groups each including a same number of the welding points, and distribution of the central angles each formed between adjacent two of the welding points in each of the groups is constant in all of the groups.

In a compressor in accordance with this aspect, because the distribution of the central angles formed between adjacent two of the welding points in each group is constant in all of the groups, all of the welding points are easily obtained by forming the welding points for each of the groups.

In accordance with another aspect of the present invention, the motor includes a rotor and a stator located radially outside of the rotor. The stator includes a stator body having a plurality of teeth which protrude radially inwardly of the stator body and are arranged in a circumferential direction of the stator body, and coils each of which is wound around one of the teeth and is not wound around two or more of the teeth.

In a compressor in accordance with this aspect, the coils of the stator are so-called concentrated windings, and the coils are easily wound around the teeth.

In accordance with another aspect of the present invention, the motor includes fitting portions to be fitted to the closed container, the number of the fitting portions is equal to or more than the number of the welding points, and the fitting portions overlap the welding points, namely, the welding points coincide with the fitting portions in position when viewed from a direction of the central axis of the closed container.

In a compressor in accordance with this aspect, because the number of the fitting portions is equal to or more than the number of the welding points and the fitting portions overlap the welding points when viewed from the central axis of the closed container, increased rigidity of the closed container is obtained.

ADVANTAGE OF THE INVENTION

According to this invention, because the direction of any of straight lines connecting any two of the welding points to each other does coincide neither with the first direction nor with the second direction which are associated with the natural vibration mode of the suction tube, the vibrations of the suction tube are reduced even if the motor vibrates.

DETAILED DESCRIPTION OF THE INVENTION

The present invention will be described in detail below with reference to the embodiment shown in the figures.

Figure 1:
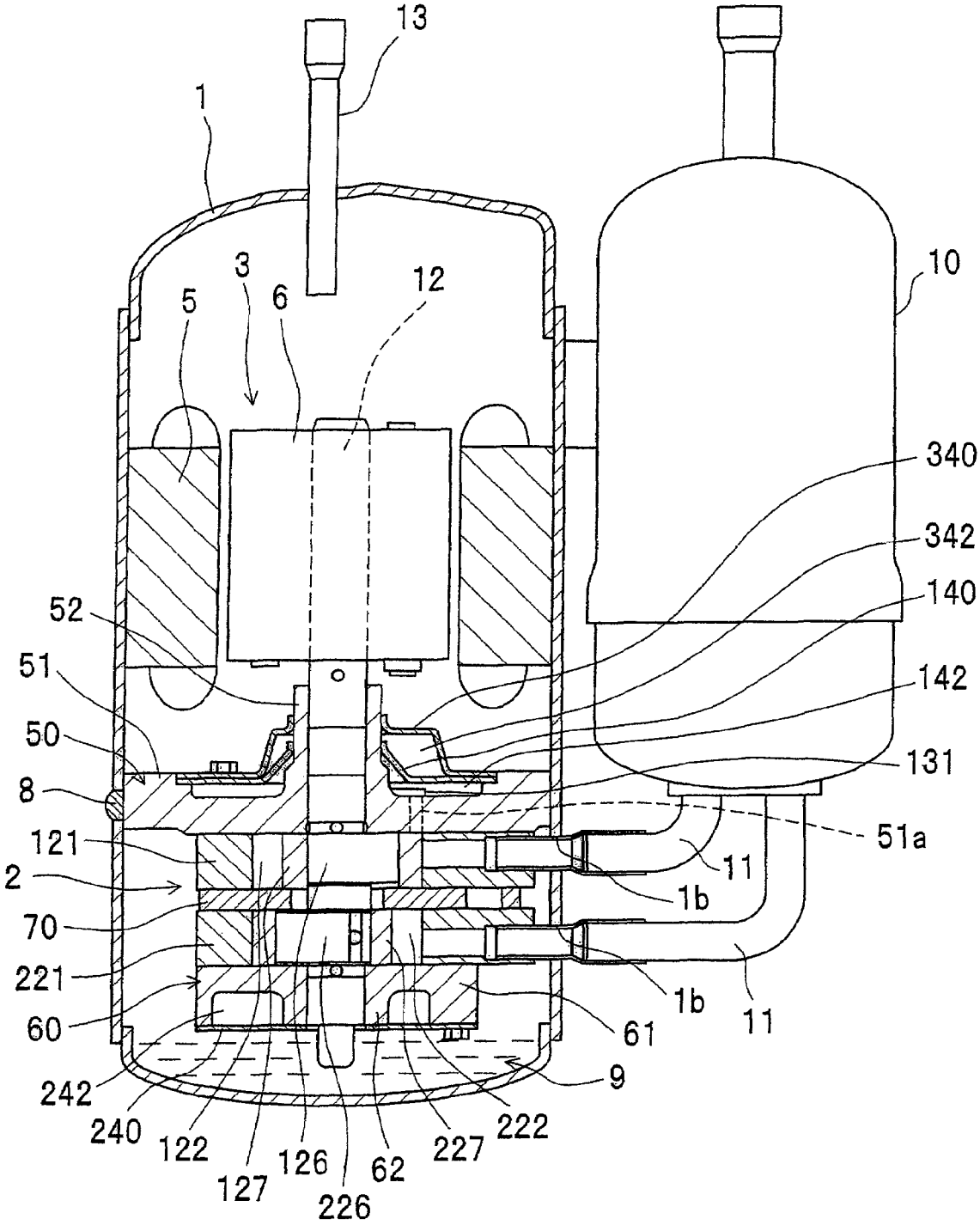
FIG. 1 is a longitudinal cross-section view showing an embodiment of the compressor according to the present invention.

FIG. 1 is a longitudinal section view of an embodiment of the compressor according to the present invention. The compressor includes a closed container 1, a compression element 2 located in the closed container 1, a motor 3 which is located in the closed container 1 and drives the compression element 2 through a shaft 12.

The compressor is a so-called high-pressure dome type rotary compressor and is provided with the compression element 2 and the motor 3 located in the lower part and the upper part of the closed container 1, respectively. The rotor 6 of the motor 3 drives the compression element 2 through the shaft 12.

Suction tubes 11 for sucking refrigerant gas are fitted to suction ports 1*b* of the closed container 1, and are connected with an accumulator 10. In other words, the compression element 2 sucks refrigerant gas from the accumulator 10 through the suction tubes 11.

The refrigerant gas is obtained by controlling a condenser, an expansion mechanism, and an evaporator (not shown in the figures), which constitute an air conditioner as an example of a refrigeration system together with the compressor.

The compressor discharges compressed high temperature high pressure gas from the compression element 2 to fill the closed container 1 with it, passes the gas through the gap between the stator 5 and the rotor 6 of the motor 3 to cool the motor 3, and then discharge the gas to the outside through a discharge tube 13. In the lower part of the high pressure region in the closed container 1, lubricating oil 9 is stored.

The compression element 2 includes an upper end-plate 50, a first cylinder 121, an intermediate end-plate 70, a second cylinder 221, and a lower end-plate 60 from top to bottom along the rotation axis of the shaft 12.

The upper end-plate 50 and the intermediate end-plate 70 are fitted to the upper open end and the lower open end of the first cylinder 121, respectively. The intermediate end-plate 70 and the lower end-plate 60 are fitted to the upper open end and the lower open end of the second cylinder 221, respectively.

The first cylinder 121, the upper end-plate 50 and the intermediate end-plate 70 define a first cylinder chamber 122. The second cylinder 221, the lower end-plate 60, and the intermediate end-plate 70 define a second cylinder chamber 222.

The upper end-plate 50 includes a disk-like body 51 and a boss 52 provided on the center part of the body 51. The body 51 and the boss 52 are penetrated by the shaft 12. The body 51 has a discharge port 51*a* communicating with the first cylinder chamber 122.

A discharge valve 131 is fitted to the body 51 at a side opposite from the first cylinder 121 of the body 51. The discharge valve 131 is, for example, a reed valve, and opens and closes the discharge port 51*a*.

A first muffler cover 140 shaped like a cup is fitted to the side opposite from the first cylinder 121 of the body 51 so as to cover the discharge valve 131. The first muffler cover 140 is fixed to the body 51 by fixing members (such as bolts). The first muffler cover 140 is penetrated by the boss 52.

The first muffler cover 140 and the upper end-plate 50 define a first muffler chamber 142. The first muffler chamber 142 and the first cylinder chamber 122 communicate with each other through the discharge port 51*a*.

The lower end-plate 60 includes a disk-like body 61 and a boss 62 provided under the center part of the body 61. The body 61 and the boss 62 are penetrated by the shaft 12. The body 61 has a discharge port (not shown) communicating with the second cylinder chamber 222.

A discharge valve (not shown) is fitted to the body 61 on a side opposite from the second cylinder 221 of the body 61. The discharge valve opens and closes the discharge port.

A second muffler cover 240 shaped like a flat plate is fitted to the side opposite from the second cylinder 221 of the body 61 so as to cover the discharge valve. The second muffler cover 240 is fixed to the body 61 by fixing members (such as bolts). The second muffler cover 240 is penetrated by the boss 62.

The second muffler cover 240 and the lower end-plate 60 define a second muffler chamber 242. The second muffler chamber 242 and the second cylinder chamber 222 communicate with each other through the discharge port.

A third muffler cover 340 shaped like a cup is also fitted to a side opposite from the upper end-plate 50 of the first muffler cover 140 so as to cover the first muffler cover 140. The first muffler cover 140 and the third muffler cover 340 define a third muffler chamber 342.

The first muffler chamber 142 and the third muffler chamber 342 communicate with each other through a hole (not shown) formed in the first muffler cover 140.

The second muffler chamber 242 and the third muffler chamber 342 communicate with each other through holes (not shown) formed in the lower end-plate 60, the second cylinder 221, the intermediate end-plate 70, the first cylinder 121, and the upper end-plate 50, respectively.

The third muffler chamber 342 and the outside of the third muffler cover 340 communicate with each other through a hole (not shown) formed in the third muffler cover 340.

The end-plates 50, 60, and 70, the cylinders 121 and 221, and the muffler covers 140, 240, and 340 are fixed together by fixing members such as bolts.

An end portion of the shaft 12 is supported by the upper end-plate 50 and the lower end-plate 60. In other words, the shaft 12 is a cantilevered one. The end portion (i.e., the supported end portion) of the shaft 12 is inserted in the first cylinder chamber 122 and the second cylinder chamber 222.

The shaft 12 is provided with a first eccentric pin 126 positioned in the first cylinder chamber 122. The first eccentric pin 126 engages with a first roller 127. The first roller 127 is located so as to be able to revolve in the first cylinder chamber 122, and a compression action is performed by the revolution of the first roller 127.

The shaft 12 is provided with a second eccentric pin 226 positioned in the second cylinder chamber 222. The second eccentric pin 226 engages with a second roller 227. The second roller 227 is located so as to be able to revolve in the second cylinder chamber 222, and a compression action is performed by the revolution of the second roller 227.

The first eccentric pin 126 and the second eccentric pin 226 are displaced 180 degrees from each other with respect to the rotation axis of the shaft 12.

Next, the compression action of the first cylinder chamber 122 will be described.

Figure 2:
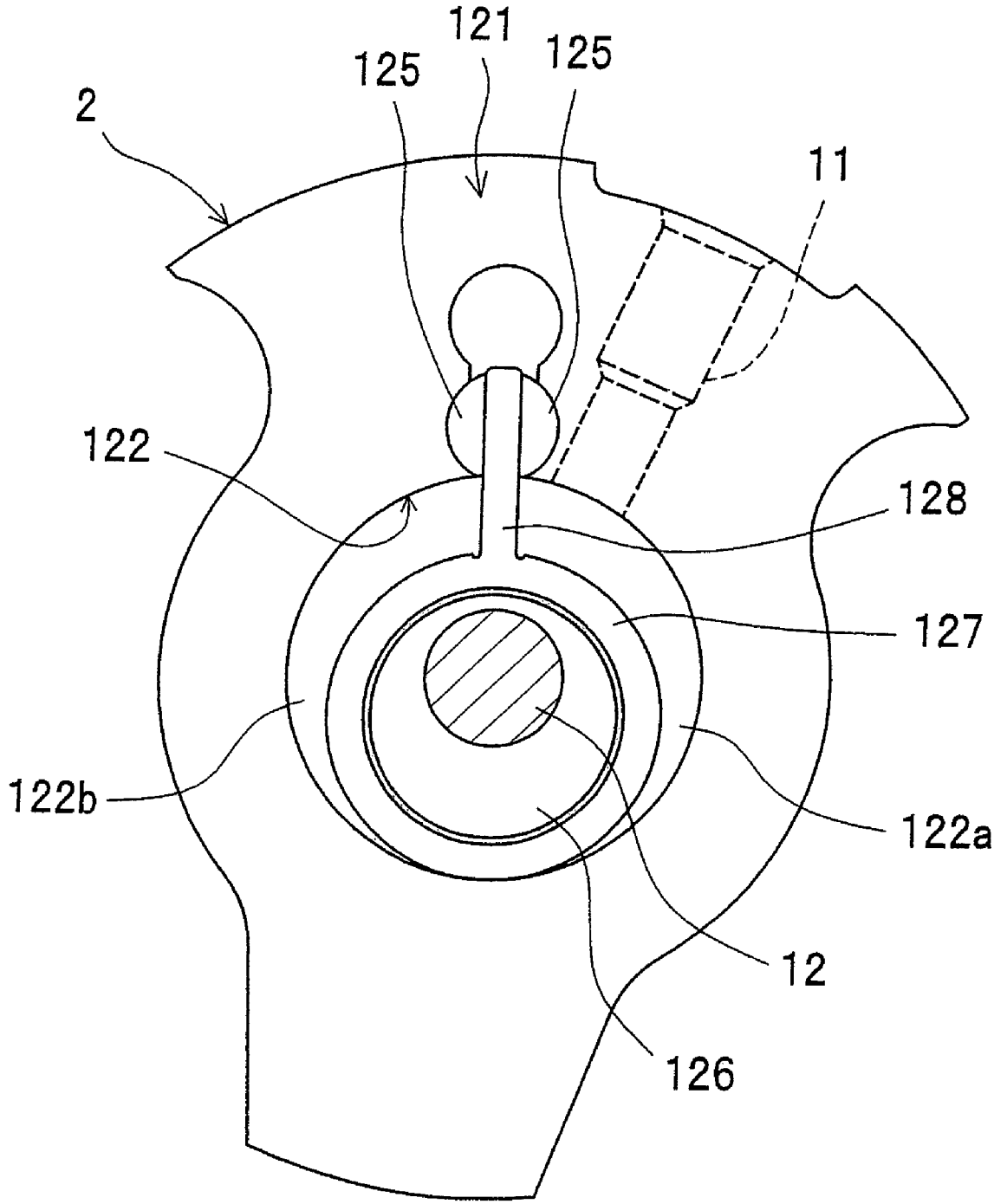
FIG. 2 is a plan view of an essential part of the compressor.

As shown in FIG. 2, the first cylinder chamber 122 is partitioned with a blade 128 formed integrally with the first roller 127. In other words, a chamber at the right of the blade 128 where one of the suction tubes 11 opens to the inner surface of the first cylinder chamber 122 forms a suction chamber (low-pressure chamber) 122*a*. On the other hand, a chamber at the left of the blade 128 where the discharge port 51*a* opens to the inner surface of the first cylinder chamber 122 forms a discharge chamber (high-pressure chamber) 122*b*.

Bushes 125, 125 each shaped like a semi-cylinder adhere to both sides of the blade 128 to seal it. The blade 128 and the bushes 125, 125 are lubricated with lubricating oil 9 in between.

The first eccentric pin 126 is eccentrically rotated with the shaft 12, so that the first roller 127 engaged with the first eccentric pin 126 revolves, with the outer surface of the first roller 127 being in contact with the inner surface of the first cylinder chamber 122.

As the first roller 127 revolves in the first cylinder chamber 122, the blade 128 travels forward and backward, with the both sides of the blade 128 held by the bushes 125,125. Then low-pressure refrigerant gas is sucked from one of the suction tubes 11 into the suction chamber 122*a* and compressed to be high pressure in the discharge chamber 122*b*, and then the high-pressure refrigerant gas is discharged from the discharge port 51*a* (shown in FIG. 1).

After that, as shown in FIG. 1, the refrigerant gas discharged from the discharge port 51*a* is discharged to the outside of the third muffler cover 340 through the first muffler chamber 142 and the third muffler chamber 342.

The compression action in the second cylinder chamber 222 is similar to the compression action in the first cylinder chamber 122. In other words, low-pressure refrigerant gas is sucked from the other of the suction tubes 11 into the second cylinder chamber 222 and compressed by the revolution of the second roller 227 in the second cylinder chamber 222, and then the high-pressure refrigerant gas is discharged to the outside of the third muffler cover 340 through the second muffler chamber 242 and the third muffler chamber 342.

There is a phase difference of 180 degrees between the compression action in the first cylinder chamber 122 and the compression action in the second cylinder chamber 222.

Figure 3:
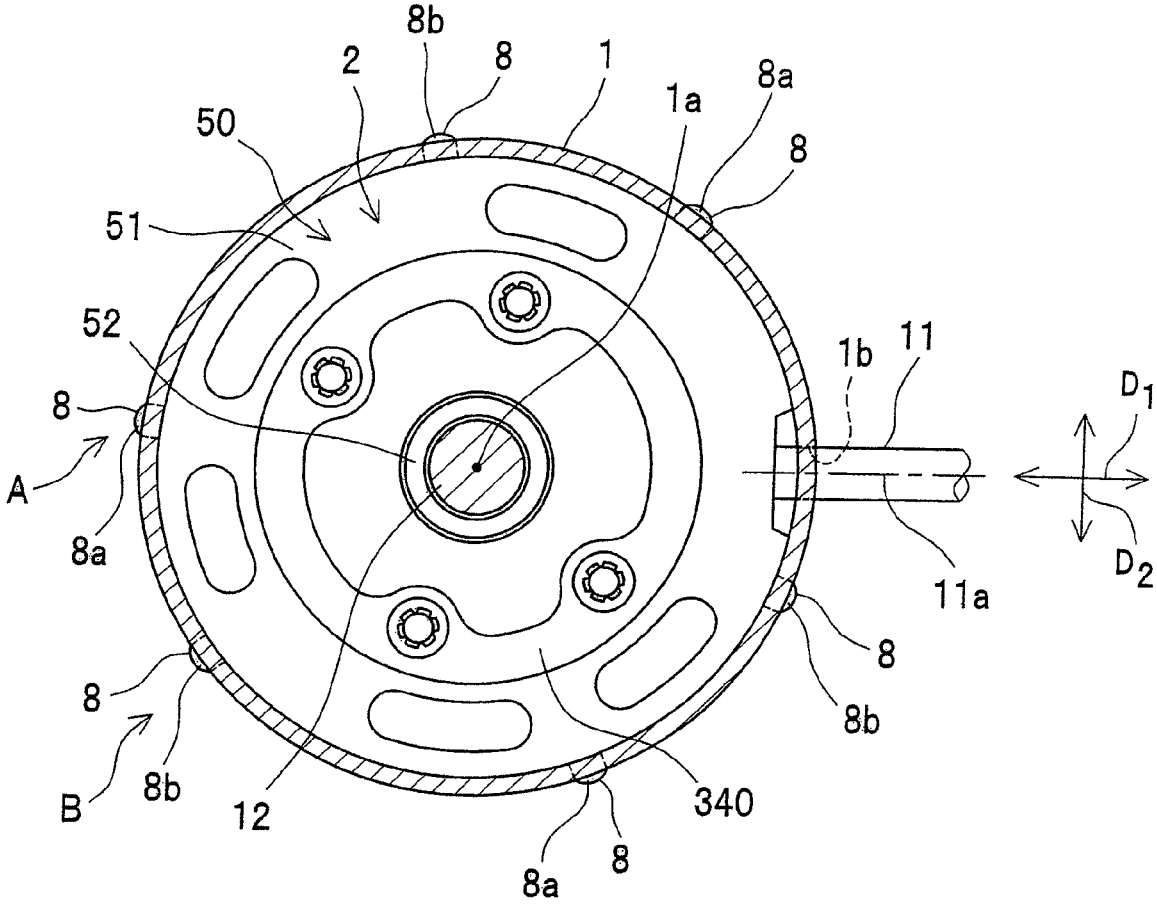
FIG. 3 is a transverse cross-section view of the neighborhood of a compression element of the compressor.

As shown in FIGS. 1 and 3, the closed container 1 and the compression element 2 are welded together. Specifically, the upper end-plate 50 of the compression element 2 is fitted to the closed container 1 at six welding points 8.

In a plane which is orthogonal to a central axis 1*a* of the closed container 1 and which passes through a central axis 11*a* of a portion near the suction port 1*b* of the suction tube 11, directions of straight lines connecting any two of the welding points 8 to each other, namely, directions in which respective two welding points 8 are aligned, coincide neither with a first direction $D_1$ in which the central axis 11*a* of the portion near the suction port 1*b* of the suction tube 11 extends nor with a second direction $D_2$ perpendicular to the first direction $D_1$. The central axis 1*a* of the closed container 1 coincides with the rotation axis of the shaft 12.

The first direction D1 and the second direction D2 are associated with the natural vibration mode of the suction tube 11. In other words, the direction of a straight line connecting any two of the welding points 8 deviates from the directions associated with the natural vibration mode of the suction tube 11.

At least one of central angles each formed between adjacent two of the welding points 8, 8 is different from other ones of the central angles. In other words, the welding points 8 are provided at an irregular pitch. In FIG. 3, three central angles of one group are identical, and three central angles of another group are identical.

All of the welding points 8 are divided into two groups A and B each including the same number of the welding points 8. In other words, one group A includes three welding points 8*a*, and the other group B also includes three welding points 8*b*.

The distribution of central angles each formed between adjacent two of the welding points 8 in each of the groups A and B is constant in all of the groups A and B. In other words, the three welding points 8*a* and the three welding points 8*b* are each arranged at the interval corresponding to the central angle of 120 degrees.

A method of welding the closed container 1 and the compression element 2 together will be described below.

First, the three welding points 8*a* of the one group A are simultaneously formed with welding equipment not shown in the figures. After that, the closed container 1 and the welding equipment are turned relatively to each other by a predetermined angle around the central axis 1*a* of the closed container 1, and then the three welding points 8*b* of the other group B are simultaneously formed with the welding equipment.

Figure 4:
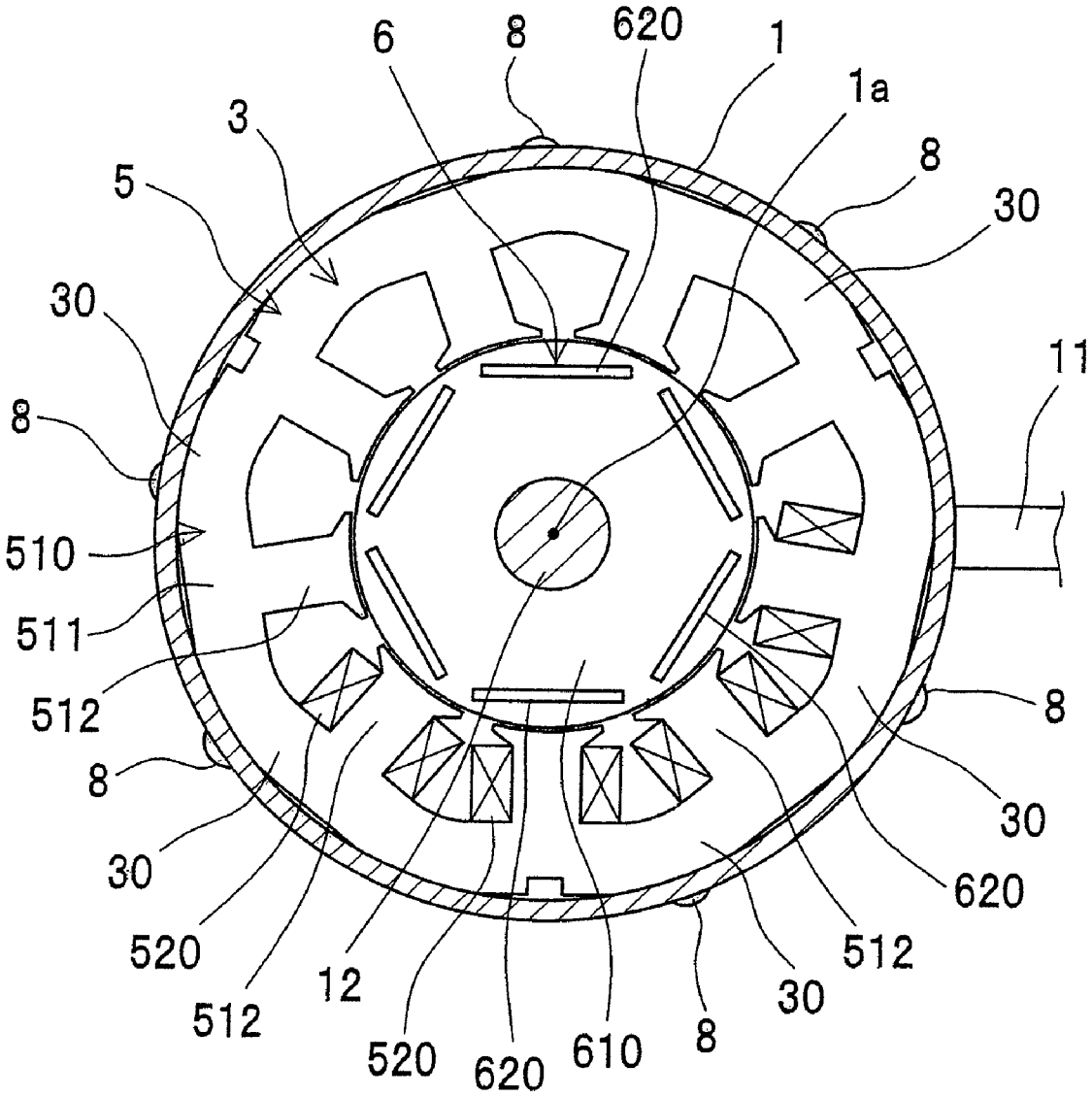
FIG. 4 is a transverse cross-section view of the neighborhood of a motor of the compressor.

As shown in FIGS. 1 and 4, the motor 3 includes the rotor 6 and the stator 5 located radially outside of the rotor 6 with an air gap therebetween.

The rotor 6 includes a rotor body 610 and magnets 620 buried in the rotor body 610. The rotor body 610 is shaped like a cylinder and is constituted of, for example, stacked magnetic steel plates. The shaft 12 is installed in a hole provided in a midsection of the rotor body 610. The magnets 620 are permanent magnets shaped like a flat plate. The six magnets 620 are arranged at a regular interval of central angles in the circumferential direction of the rotor body 610.

The stator 5 includes a stator body 510 and coils 520 wound on the stator body 510. In FIG. 4, part of the coils 520 are omitted.

The stator body 510 is made of, for example, iron. The stator body 510 includes a ring portion 511 and nine teeth 512 which protrude from the inner surface of the ring portion 511 in the radial direction and are arranged at a regular interval in the circumferential direction of the ring portion. The coils 520 are so-called concentrated windings which are each wound around a respective one of the teeth 512 and are not wound around two or more of the teeth 512.

The motor 3 is a so-called 6-pole 9-slot motor. An electromagnetic force generated in the stator when passing a current through the coils rotates the rotor 6 along with the shaft 12.

The motor 3 includes fitting portions 30 fitted to the closed container 1. The stator 5 is fitted to the closed container 1 by shrink fitting or the like. The outer surface of the ring portion 511 is fixed to the closed container 1 at portions of the outer surface each located between adjacent two of the teeth 512, 512. In other words, those portions of the outer surface of the ring portion 511 are the fitting portions 30.

The number of the fitting portions 30 is nine which is equal to or more than the number of the welding points 8. The fitting portions 30 overlap the welding points 8 when viewed from the central axis 1*a* of the closed container 1.

According to the compressor configured as above, none of the directions of straight lines connecting any two of the welding points 8 to each other coincide with the first direction D1 or the second direction D2 which are associated with the natural vibration mode of the suction tube 11, so that the vibrations of the suction tube 11 and the accumulator 10 are reduced by the arrangement of the welding points 8 even if the vibration of the rotor 6 of the motor 3 is transmitted to the compression element 2. Furthermore, since the number of the welding points 8 is three or more, a high supporting rigidity of the compression element is obtained. Thus, the increase of the supporting rigidity of the compression element 2 is compatible with the reductions of the vibrations of the suction tube 11 and the accumulator 10.

Furthermore, since the upper end-plate 50 is fixed to the closed container 1, the distances between the rotor 6 and the welding points 8 can be reduced and thereby the vibration of the rotor 6 can be reduced.

Furthermore, since at least one of central angles each formed between adjacent two of the welding points 8, 8 is different from the other ones of the central angles, the directions in which the vibration of the motor 3 is transmitted to the closed container 1 are distributed or made different and thereby the vibration of the closed container 1 may be reduced.

Furthermore, since the distribution, or allocation, of the central angles each formed between adjacent two of the welding points 8, 8 are the same in all of the groups A and B, all of the welding points 8 can be easily formed by forming the welding points 8 for each of the groups A and B.

Furthermore, since the coils of the stator 5 are so-called concentrated windings, the coils 520 can be easily wound around the teeth 512. Because the coils 520 are concentrated windings, the electromagnetic force per each of the teeth 512 increases and thereby the vibration of the rotor increases. However, the vibrations of the suction tubes 11 can be surely reduced by the arrangement of the welding points 8.

Furthermore, since the motor 3 is a so-called 6-pole 9-slot motor, the vibration of the rotor 6 can be reduced by increasing the number of slots, that is, the number of the teeth 512 to distribute the directions of the electromagnetic force applied to the rotor 6.

Furthermore, since the number of the fitting portions 30 is equal to or more than the number of the welding points 8 and the fitting portions 30 overlap the welding points 8 when viewed from the central axis 1*a* of the closed container 1, the rigidity of the closed container 1 can be increased.

The present invention is not limited to the above embodiment. For example, the compression element 2 may be of a rotary type in which the rollers are separated from the blades. The compression element 2 may be of a scroll type or a reciprocating type other than a rotary type. The compression element 2 may be of a one-cylinder type having one cylinder chamber. The coils 520 may be so-called distributed windings wound around two or more of the teeth 512. The numbers of the teeth 512 and the magnets 620 can be increased or decreased freely.

Furthermore, the number of the welding points only has to be three or more. The welding points 8 may be divided into three or more groups with an equal number. Central angles each formed between adjacent two of the welding points 8, 8 may be identical for all of the welding points, in other words, all of the welding points 8 may be provided at the same pitch. Furthermore, any structural component of an outdoor unit, for example, may be directly connected to the suction tubes 11 without providing the accumulator 10.

What is claimed is:

1. A compressor comprising:

a closed container;

a compression element located in the closed container; and a motor located in the closed container, the motor being arranged to drive the compression element via a shaft, the closed container and the compression element being welded together at at least three welding points, the closed container having a suction port with a suction tube fitted to the suction port of the closed container with the suction tube being arranged and configured to suck a refrigerant gas, and the suction tube having a central axis that lies in a plane which is orthogonal to a central axis of the closed container and that passes through the suction port, the welding points being arranged such that straight lines connecting all combinations of any two of the welding points are neither parallel to the central axis of the suction tube nor perpendicular to the central axis of the suction tube, and are angled more than 5 degrees relative to the central axis of the suction tube, there being an even number of the welding points with the even number being at least six, and all of the welding points being divided into at least two groups with each of the last two groups including an identical number of the welding points;

the welding points being spaced from each other to form a plurality of central angles between the welding points, and a distribution of the central angles being formed between the welding points of each of the at least two groups, with distributions being identical amongst all of the at least two groups; and the welding points of each of the at least two groups being arranged in a circumferential direction about the central axis of the closed container such that the welding points of one of the at least two groups alternate with corresponding welding points of at least another group.

2. The compressor according to claim 1, wherein the suction tube has an accumulator connected thereto.

3. A compressor as claimed in claim 1, wherein at least one of the central angles is different from another one of the central angles.

4. The compressor according to claim 1, wherein adjacent pairs of the plurality of central angles include a first central angle and a second central angle larger than the first central angle.

5. The compressor according to claim 1, wherein the motor includes a rotor and a stator located radially outside of the rotor; and the stator includes a plurality of coils and a stator body having a plurality of teeth, the teeth protruding radially inwardly of the stator body and being arranged in a circumferential direction of the stator body, and each of the coils being wound around only one of the teeth.

6. A compressor comprising:

a closed container;

a compression element located in the closed container; and a motor located in the closed container, the motor being arranged to drive the compression element via a shaft, the closed container and the compression element being welded together at at least three welding points, the closed container having a suction port with a suction tube fitted to the suction port of the closed container with the suction tube being arranged and configured to suck refrigerant gas, and the suction tube having a central axis that lies in a plane which is orthogonal to a central axis of the closed container and that passes through the suction port, the welding points being arranged such that straight lines connecting all combinations of any two of the welding points are neither parallel to the central axis of the suction tube nor perpendicular to the central axis of the suction tube, and are angled more than 5 degrees relative to the central axis of the suction tube, the motor including a plurality of fitting portions arranged and configured to be fitted to the closed container, with a plurality of gaps being formed between the fitting portions;

the number of the fitting portions being equal to or more than the number of the welding points; and each of the welding points being circumferentially aligned with one of the fitting portions when viewed along the central axis of the closed container.

7. The compressor according to claim 6, wherein the suction tube has an accumulator connected thereto.

8. A compressor as claimed in claim 6, wherein the welding points are spaced from each other to form a plurality of central angles between adjacent pairs of the welding points, and at least one of the central angles is different from another one of the central angles.

9. The compressor according to claim 6, wherein there are an even number of the welding points, and all of the welding points are divided into at least two groups with each of the at least two groups including an identical number of the welding points;

the welding points are spaced from each other to form a plurality of central angles between the welding points, and a distribution of the central angles being formed between the welding points of each of the at least two groups, with distributions being identical amongst all of the at least two groups; and the welding points of each of the at least two groups are arranged in a circumferential direction about the central axis of the closed container such that the welding points of one of the at least two groups alternate with corresponding welding points of at least another group.

10. The compressor according to claim 6, wherein the motor includes a rotor and a stator located radially outside of the rotor; and the stator includes a plurality of coils and a stator body having a plurality of teeth, the teeth protruding radially inwardly of the stator body and being arranged in a circumferential direction of the stator body, and each of the coils being wound around only one of the teeth.

11. The compressor according to claim 6, wherein there are a larger number of fitting portions and gaps than the number of welding points and the fitting portions are equally spaced from each other.

12. The compressor according to claim 6, wherein the welding points are spaced from each other to form a plurality of central angles between adjacent pairs of the welding points, and adjacent pairs of the plurality of central angles a first central angle and a second central angle larger than the first central angle.

* * * * *